US006499612B1

(12) United States Patent
Harrgington et al.

(10) Patent No.: US 6,499,612 B1
(45) Date of Patent: Dec. 31, 2002

(54) TELESCOPING BOOM ASSEMBLY WITH ROUNDED PROFILE SECTIONS AND INTERCHANGEABLE WEAR PADS

(75) Inventors: Daniel L. Harrgington, Lexington, KY (US); Shannon J. Murphy, Lexington, KY (US)

(73) Assignees: Link-Belt Construction Equipment Co., L.P., LLLP, Lexington, KY (US); Sumitomo Construction Machinery, Lexington, KY (US)

( * ) Notice: Subject to any disclaimer, the term of this patent is extended or adjusted under 35 U.S.C. 154(b) by 0 days.

(21) Appl. No.: 09/917,060

(22) Filed: Jul. 27, 2001

(51) Int. Cl.[7] ..... B66C 23/04
(52) U.S. Cl. ..... 212/350; 212/270
(58) Field of Search ..... 212/350, 319, 212/296, 270; 52/118

(56) References Cited

U.S. PATENT DOCUMENTS

| | | | |
|---|---|---|---|
| 3,481,490 | A | 12/1969 | Eiler |
| 3,796,016 | A | 3/1974 | Wu |
| 3,931,698 | A | 1/1976 | Ebersold |
| 4,016,688 | A | 4/1977 | Tiffin et al. |
| 4,036,372 | A | 7/1977 | Rao et al. |
| 4,038,794 | A | 8/1977 | Young |
| 4,148,531 | A | 4/1979 | Hornagold |
| 4,171,597 | A | 10/1979 | Lester et al. |
| 4,257,201 | A | 3/1981 | Landolt et al. |
| 4,327,533 | A | 5/1982 | Sterner |
| 4,337,601 | A | 7/1982 | Vaerk et al. |
| 4,357,785 | A | 11/1982 | Eklund |
| 4,396,126 | A | 8/1983 | Moravec et al. |
| 4,459,786 | A | 7/1984 | Pitman et al. |
| 4,478,014 | A | 10/1984 | Poock et al. |
| 4,483,109 | A | 11/1984 | MacDonald et al. |
| 4,490,951 | A | 1/1985 | Mentzer et al. |

(List continued on next page.)

FOREIGN PATENT DOCUMENTS

| | | | | |
|---|---|---|---|---|
| DE | 2317595 | | 10/1974 | |
| DE | 3015599 | | 10/1981 | |
| DE | 3042993 | | 7/1982 | |
| DE | 3101017 | | 8/1982 | |
| EP | 0 668 238 | | 2/1995 | |
| EP | 0 499 208 | | 6/1995 | |
| GB | 2 134 072 | * | 8/1984 | ..... 212/350 |

OTHER PUBLICATIONS

"Well–rounded New rounded boom styles all AT cranes to perform better and travel lighter" The Industrial Evolution, Nov.–Dec. 1999 CraneWorks 65.

"Dematic Redesigns AC 100 boom," International Cranes, May 2000.

"Industrial Vehicle Technology '99" date and author unknown.

"Twin–Lock" Boom Telescoping System date and author unknown.

*Primary Examiner*—Thomas J. Brahan
(74) *Attorney, Agent, or Firm*—King & Schickli, PLLC

(57) ABSTRACT

A boom assembly for a crane or other lifting device is provided. The boom assembly includes a plurality of telescoping boom sections, each having an at least partially rounded portion, and a plurality of corresponding wear pads for reducing friction between the adjacent boom sections during relative telescoping movement. The rounded portion includes a plurality of equiangular breaks. Each wear pad is substantially identical and includes a contoured engagement surface for positioning adjacent to one of the plurality of breaks at the lower front end of each boom section. The identical wear pads are interchangeable, which eliminates the need for keeping a plurality of substantially different shapes or sizes of wear pads on hand for positioning at the lower front ends of adjacent boom sections. Spacers may also be provided between the wear pads positioned adjacent to the breaks on outer boom sections to prevent shifting during the relative telescoping movement.

23 Claims, 7 Drawing Sheets

U.S. PATENT DOCUMENTS

| | | | |
|---|---|---|---|
| 4,494,351 | A | 1/1985 | Thomasson |
| 4,660,731 | A | 4/1987 | Becker |
| 4,976,361 | A | 12/1990 | Becker |
| 5,158,189 | A | 10/1992 | Watson et al. |
| 5,465,854 | A | 11/1995 | Sturm et al. |
| 5,515,654 | A | 5/1996 | Anderson |
| 5,628,416 | A | 5/1997 | Frommelt et al. |
| 5,829,606 | A | 11/1998 | Erdmann |
| 5,865,328 | A | 2/1999 | Kaspar |
| 5,884,791 | A | 3/1999 | Vohdin et al. |
| 6,089,388 | A | 7/2000 | Willim |
| 6,098,824 | A | 8/2000 | Krebs et al. |
| 6,108,985 | A | 8/2000 | Paschke et al. |
| 6,109,394 | A | 8/2000 | Messenger |
| 6,164,468 | A | 12/2000 | Erdmann |
| 6,216,895 | B1 | 4/2001 | Erdmann et al. |

* cited by examiner

Fig. 2b
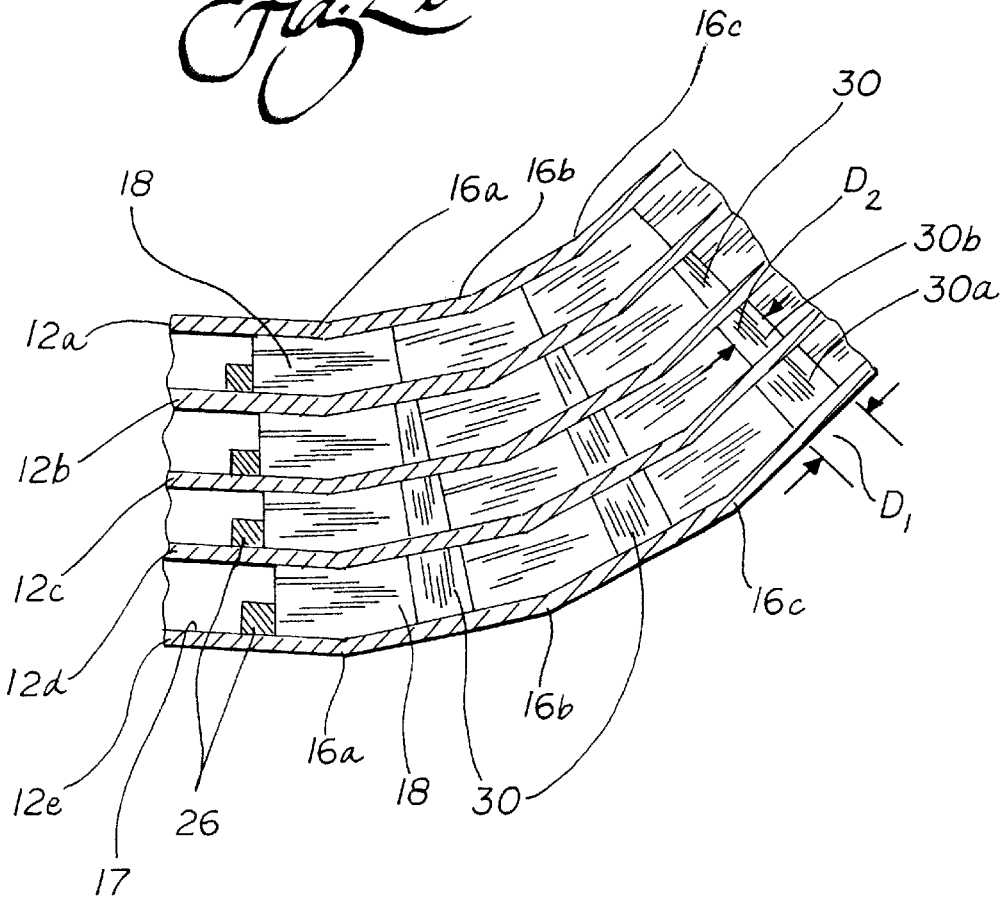
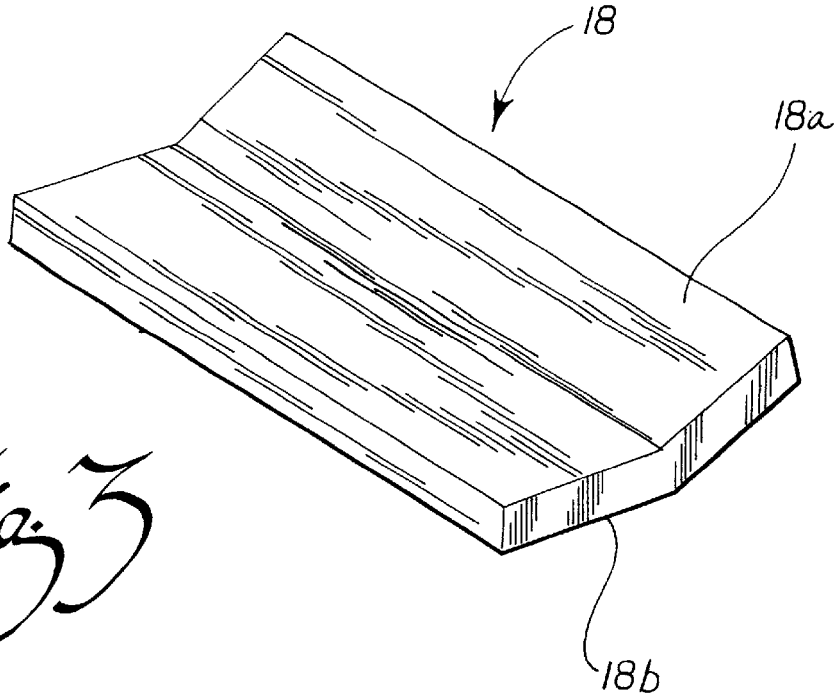
Fig. 3

TELESCOPING BOOM ASSEMBLY WITH ROUNDED PROFILE SECTIONS AND INTERCHANGEABLE WEAR PADS

TECHNICAL FIELD

The present invention relates generally to lifting devices, such as cranes or the like, and more particularly to a boom assembly comprised of a plurality of telescoping boom sections and corresponding interchangeable wear pads for reducing the friction during the relative telescoping movement.

BACKGROUND OF THE INVENTION

Various types of telescoping booms or boom assemblies for use in cranes or other lifting devices are known in the art. Typically, the boom assembly includes a plurality of nested tubular sections, with each outer section having a larger cross-sectional size than the next-adjacent inner section to permit the desired relative telescoping movement. In the typical arrangement, the proximal end of the outermost boom section is pivotally mounted on a turntable, and the distal end of the innermost section carries one or more sheaves or equivalent structures for supporting the hoisting cable or the like. Friction-reducing structures, such as wear pads, shoes (also known as "slippers"), or like structures formed of a wear-resistant material with enhanced tribological characteristics are normally provided between the adjacent boom sections to provide support and reduce friction during the relative telescoping movement. A basic example of such an arrangement is shown in Kidde's U.S. Pat. No. 5,829,606 to Erdmann.

In recent years, the general direction of progress in the art has been away from a conventional boom section formed having a square or rectangular cross-sectional profile, as shown in the '606 patent, and towards a boom section having a cross-sectional profile that is at least partially rounded. As should be appreciated, a boom section with a partially rounded profile requires less material to manufacture and is thus lighter in weight. In addition to reducing weight and conserving material, it has been discovered that a boom section with a partially rounded profile is able to resist equal or greater bending stresses than the square or rectangular counterpart. Representative examples of proposals for modem telescoping boom assemblies including having partially rounded boom sections are found in Grove's U.S. Pat. No. 6,108,985 to Paschke et al., Kidde's U.S. Pat. No. 5,884,791 to Vohdin et al., and Liebherr's European Published Patent Application 0 583 552. In particular, each of these references discloses a boom assembly including a plurality of telescoping boom sections, each having a rounded lower portion defined by a plurality of non-equidistant, non-equiangular breaks.

Despite the advantages generally afforded by the partially rounded profiles formed by breaks of the type disclosed in these references, a significant, but heretofore unrecognized problem arises with regard to the corresponding wear shoes or pads used to reduce the friction between the lower front ends of the boom sections during telescoping movement. In particular, since the angle forming each break and the distance between adjacent breaks is substantially different, a plurality of different sizes and shapes of wear pads are required for engaging one or more of the different length segments ("flats") created. This problem is further compounded by the fact that different sizes of wear pads are required for supporting the various different sizes of nesting boom sections. For example, in the boom assembly disclosed in the Grove '985 patent, at least three different types of wear "slippers" are required for positioning between the lower front ends of each adjacent pair of telescoping boom sections. In the case where three telescoping boom sections form the boom assembly, at least six different types of wear slippers must be kept on hand or in inventory; for four boom sections, at least nine different types of wear slippers are required; and telescoping boom assemblies formed of five boom sections require at least twelve different types of wear slippers.

As should be appreciated, the requirement for having multiple types of non-interchangeable wear pads is disadvantageous, since it increases the cost from both the manufacturing and production standpoint. An associated consequence is the need for the crane operator to keep the various different types of wear pads on hand at the job site, in case there is an immediate need for replacement. Even in the case where the wear pads are inspected between jobs and replaced if excessive wear is observed, the manufacturer of the crane must still keep a ready supply of the different types of replacement wear pads available throughout the service life of the crane or other lifting device using such a boom assembly. This not only increases the amount of inventory and the associated expense that must be borne by the crane manufacturer (and ultimately passed on to the crane operator), but it also creates deleterious inventory management and control problems. The net result is an increase in the overall manufacturing and operational cost of the crane or other lifting device having a boom assembly with several different types of non-identical wear pads or shoes for supporting the lower front end of each adjacent boom section during telescoping movement.

Accordingly, a need is identified for an improved boom assembly and a corresponding arrangement of friction or wear-reducing structures that address and overcome the foregoing limitations of the prior art arrangements. In particular, the telescoping sections forming the boom assembly would have the desirable partially rounded profile for reduced weight, enhanced stiffness and added strength, but would be adapted for receiving a plurality of interchangeable wear pads along the rounded portion. As a result, the need for keeping different types of wear pads on hand for supporting each boom section and by engaging the rounded portion would be eliminated, and an improved boom assembly would be provided, especially in terms of reduced manufacturing and operational expense.

SUMMARY OF THE INVENTION

In accordance with a first aspect of the invention, a boom assembly for a crane or other lifting device is provided. The boom assembly is comprised of at least two adjacent telescoping boom sections. A first of the telescoping boom sections includes a rounded portion formed by a plurality of substantially equiangular breaks. A plurality of substantially identical wear pads are also provided as part of the assembly for reducing friction between the adjacent boom sections during telescoping movement. In use, each wear pad is positioned adjacent to one of the breaks relative to the first boom section and supported by a matching second, adjacent telescoping boom section. Hence, the wear pads not only reduce friction in the desired manner, but also are freely interchangeable. Advantageously, this eliminates the need for keeping a plurality of different types of non-identical replacement wear pads on hand such as for positioning between the lower front ends of adjacent boom sections, either at the job site or in the inventory kept by the manufacturer at a remote location.

In one embodiment, each of the plurality of breaks formed in each side of the lower portion of the first boom section are equidistant from each other. Additionally, at least a portion of the outer surface of the first boom section on either side of each break is substantially flat. To ensure that intimate contact is established with the corresponding boom section, including the flat segments between the adjacent breaks, each substantially identical wear pad is provided with a contoured engagement surface. This contoured engagement surface is preferably substantially V-shaped to match the shape of the corresponding outer surface of the boom section. However, the use of other equivalent shapes or contours capable of achieving the desired friction-reducing engagement is also possible.

Normally, the boom is formed of three or more nested telescoping boom sections, each identical in shape and increasing in cross-sectional size from the innermost to the outermost boom section. In the case of an innermost boom section having a smaller cross-sectional profile than any of the outer boom sections, each identical wear pad is preferably sized such that it may be positioned adjacent to an adjoining wear pad to create a substantially continuous wear surface. For the outer boom sections, each of which is slightly larger in cross-section than the next-adjacent inner boom section to permit telescoping, a plurality of spacers are provided for filling any gap between adjacent identical wear pads positioned at the breaks (each of which may also be equidistant from each other along each side of the boom section, but of course are farther apart than the equidistant breaks on the next adjacent inner boom section). As should be appreciated, the spacers also keep the wear pads positioned at the breaks by preventing shifting during the telescoping of the adjacent boom section.

A retainer is also preferably provided on each outer boom section for holding the wear pads and/or spacers in place during the relative telescoping movement of the next-adjacent inner boom section. As a result of using identical wear pads, the retainer may have a relatively simple construction, as compared to past arrangements where separate retainer structures are required for accommodating each different type of wear pad.

Friction-reducing support structures, such as L-shaped wear shoes, may also be provided on each outer boom section for engaging an upper surface of the adjacent nested boom section. These upper wear shoes may be removed from the mounted position to allow for the lifting of the corresponding next-adjacent boom section. This lifting creates a clearance or space for gaining access to the wear pads and/or spacers without the need for completely disassembling the boom assembly. A mechanism may also be provided for permitting the selective adjustment of the position of the upper wear shoes relative to the adjacent upper portion of the corresponding boom section. This feature not only allows for the degree of frictional engagement with the wear pads to be selectively controlled, but also advantageously allows a worker to fine tune the alignment of the adjacent boom section.

In accordance with a second aspect of the invention, a crane including an improved apparatus for assisting in lifting or moving a load is provided. The apparatus comprises a telescoping boom assembly including at least two adjacent telescoping boom sections. A first of the boom sections includes a rounded portion having a plurality of substantially equiangular breaks. A plurality of substantially identical wear pads are provided for reducing friction between the adjacent boom sections during relative telescoping movement. In particular, each wear pad is positioned adjacent to one of said breaks of the first boom section and supported by a second, adjacent telescoping boom section. In addition to reducing friction, the identical wear pads are fully interchangeable, which advantageously eliminates the need for keeping a plurality of substantially different wear pads on hand.

In accordance with a third aspect of the invention, a friction reducing structure is provided for use in a crane or lifting device having a boom assembly comprised of first and second adjacent telescoping boom sections, with at least the first boom section having a rounded portion defined by a plurality of substantially equiangular breaks. The friction reducing structure comprises a plurality of substantially identical wear pads having V-shaped engagement surfaces, each for positioning adjacent to one of the equiangular breaks of the first boom section and supported by the second, adjacent telescoping boom section. The substantially identical wear pads or shoes not only reduce friction between the adjacent boom sections, but are interchangeable to eliminate the need for keeping a plurality of substantially different sizes or shapes of wear pads for positioning between the lower front ends of adjacent boom sections on hand.

In accordance with a fourth aspect of the invention, a method for reducing friction in a boom assembly including at least two adjacent telescoping sections is provided. The method comprises placing a plurality of substantially identical wear pads adjacent to a corresponding plurality of substantially equiangular breaks forming a rounded portion of a first of the two adjacent telescoping boom sections. As a result of using substantially identical wear pads, the costs and other difficulties associated with controlling a large inventory of non-identical wear pads are substantially reduced while the desirable friction reduction between the adjacent boom sections during telescoping is advantageously achieved in the desired manner.

To place the identical wear pads in the operative position, raising the first boom section relative to a second adjacent boom section may be required, which as described above may involve removing any upper wear shoes or other friction reducing structures present. This creates a clearance or space between the adjacent boom sections for inserting or removing each of the substantially identical wear pads. In the case where the wear pads positioned at the breaks are not adjoining or contiguous, such as on outer boom sections, the step of placing may further include providing a spacer in any gap or space between the substantially identical wear pads positioned at adjacent breaks. The spacers substantially prevent the wear pads from shifting relative to each other.

In one embodiment of the method, a plurality of rounded boom sections are provided, each having an identical number of breaks. However, because each outer boom section is larger than the next-adjacent inner boom section, the corresponding breaks are equidistant but are spaced farther apart from each other. In this case, the step of placing further includes: (1) providing a first spacer having a first width dimension between the wear pads adjacent to a second boom section having a plurality of equidistant breaks that are closer together than a next-adjacent third boom section; and (2) providing a second spacer having a second width dimension between the wear pads adjacent to a fourth boom section having a plurality of equidistant breaks that are spaced farther apart than the breaks on the third boom section. Using this arrangement, the wear pads remain interchangeable among the different sizes of telescoping boom sections, with only the dimensions of the spacers changing between the adjacent outer boom sections.

BRIEF DESCRIPTION OF THE DRAWINGS

The accompanying drawings incorporated in and forming a part of the specification illustrate several aspects of the present invention and, together with the description, serve to explain the principles of the invention.

In the drawings:

FIG. 2*b* is a cutaway, enlarged cross-sectional view of the telescoping boom assembly of FIGS. 1 and 2*a*, including the identical wear pads positioned adjacent to the breaks forming the rounded portion of each boom section;

FIG. 3 is a perspective view of a single wear pad showing the V-shaped upper engagement surface;

FIG. 4 is a partially cutaway exploded view of one possible arrangement for reducing friction between the upper portion of an inner boom section and the corresponding upper portion of the next-adjacent outer boom section;

DETAILED DESCRIPTION OF THE INVENTION

Figure 1:
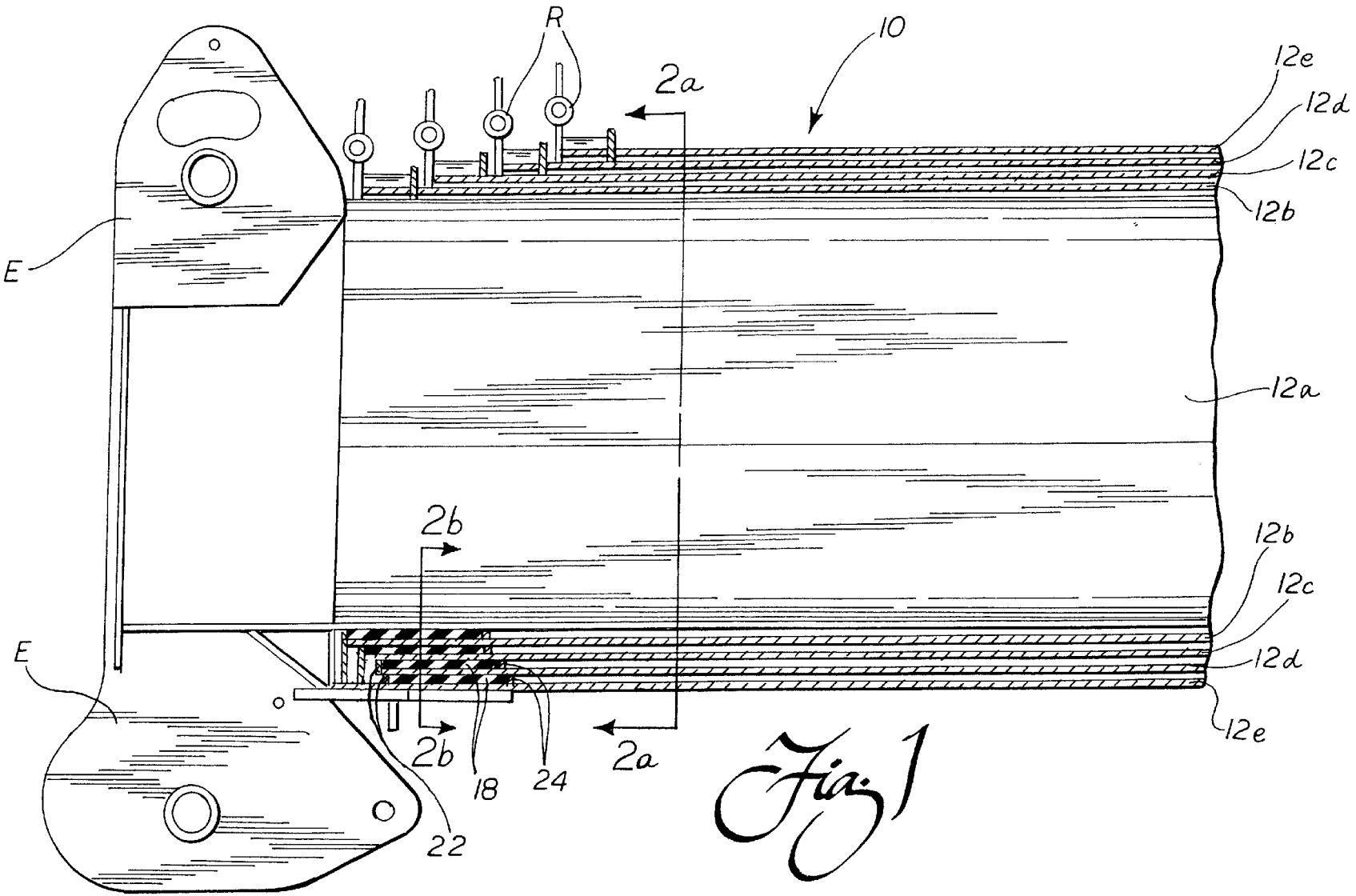
FIG. 1 is a partially cross-sectional, partially cutaway side elevational view of a boom assembly including a plurality of nested boom sections, each having a rounded portion for engaging adjacent wear pads.

Reference is now made to FIG. 1, which is a partially cross-sectional, partially cutaway side elevational view of a telescoping boom assembly 10 constructed in accordance with the principles of the present invention. In the embodiment illustrated in FIG. 1, the boom assembly 10 includes five matching boom sections 12*a*–12*e*, although it should be appreciated that more or fewer sections may be provided. The distal end of the innermost boom section 12*a* (known as the "tip" section) having the smallest cross-sectional size typically carries a head end structure E. The head end structure E provides a frame for supporting one or more sheaves (not shown) or other rotatably mounted structures that engage a hoisting cable (not shown) extending from a winch on the base of the crane.

Normally, the proximal end of the outermost boom section 12*e* is pivotably and rotatably mounted to the base of the crane (not shown), such as on a rotating turntable. Thus, in addition to telescoping, the boom assembly 10 may simultaneously pivot and rotate to allow for any load being lifted to be raised or lowered to a certain height or moved to a particular location. As is known in the art, the telescoping action may be provided by a boom cylinder (not shown) positioned inside of the innermost boom section 12*a* (preferably with the rod end of the cylinder nearest the pivot point) and including remotely actuated structures that are capable of latching on to one of the inner boom sections 12*a*–12*d* for moving it relative to the next-adjacent boom section 12*b*–12*d*. Once a selected boom section 12*a*–12*d* is extended as desired, a locking mechanism (not shown) may be automatically or manually actuated to secure it in place relative to an adjacent boom section, as is known in the art.

Figure 2A:
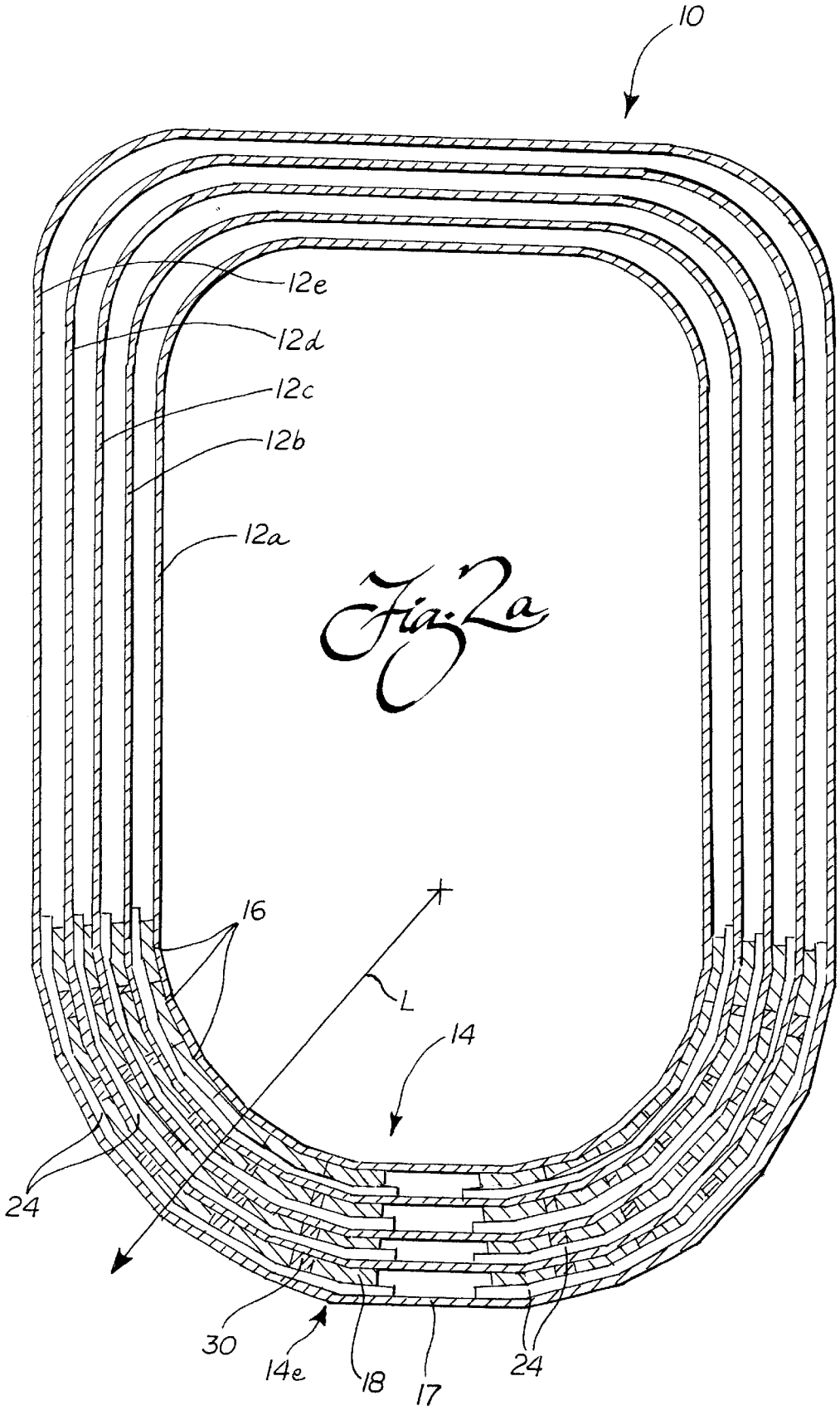
FIG. 2*a* is a cross-sectional view taken along line 2*a*—2*a* of FIG. 1.

As best understood with reference to FIG. 2*a*, the five matching boom sections 12*a*–12*e* each have a rounded lower portion 14. This rounded lower portion 14 of each boom section 12*a*–12*e* is defined by a plurality of equiangular breaks 16. These breaks 16 are formed in the material at strategic locations as part of the process of manufacturing each boom section 12*a*–12*e* (such as using a conventional press break to form bends in an initially flat piece of material). It should be appreciated that in addition to being lighter in weight and equally strong, a boom section having a rounded portion, including one having breaks 16, is generally easier to manufacture than the corresponding square or rectangular sections. This is primarily because the need for welding four separate corner pieces in place is eliminated, as is the need for a press for straightening the sections to eliminate any bend resulting from the heat introduced during the welding process. In addition, the rounded profile may eliminate the need for forming cutouts in the sidewalls of each boom section to enhance the stiffness.

In the illustrated embodiment, twelve breaks are provided along the lower portion of each boom section 12*a*–12*e* (two sets of six on each side), although the particular number of breaks is not critical to the present invention. As a result of the equiangular condition, it should be appreciated that the distance between the breaks 16 on each side of a single boom section 12*a* is substantially the same. However, as should also be appreciated, this distance changes accordingly as the boom sections 12*a*–12*e* increase or decrease in size (or as the number of breaks, and hence the angle, is increased or decreased). This is perhaps best understood with reference to the enlarged cross-sectional view provided in FIG. 2*b*, which shows that the relative distance from a first break 16*a* to a second break 16*b* (or from the second break 16*b* to a third break 16*c*) is the same along the each respective side of each boom section 12*a*–12*e*. Hence, in the embodiment shown, the breaks 16 on the side of each boom section 12*a*–12*e* are not only formed at equal angles, but are also substantially equidistant from one another. As shown in FIG. 2*a*, the breaks 16 of the five adjacent boom sections 12*a*–12*e* also align along a radial line L drawn from an imaginary center point inside the innermost boom section 12*a*.

As should be appreciated, the outer surface of each boom section 12*a*–12*e* surrounding each break 16 is substantially flat. A flat segment 17 is also provided along a lowermost portion of each boom section 12*a*–12*e* between the adjacent breaks 16 initially forming the curved lower portion. However, it should be appreciated that by changing the dimensions of the boom sections 12*a*–12*e* or adjusting the angles to create a greater or lesser number of breaks 16, this flat portion 17 may be increased or decreased in size.

In accordance with an important aspect of the invention, and with continued reference to FIGS. 2*a* and 2*b*, a plurality of identical wear pads 18 are provided for reducing friction between a front lower portion of each adjacent boom section 12*a*–12*d* capable of telescoping relative to the next-adjacent boom section 12*b*–12*e* (such as the innermost section 12*a* and the next-adjacent outer section 12*b*). Preferably, each identical wear pad 18 is provided with a contoured upper surface 18*a* for engaging one of the breaks 16, each of which is generally the stiffest part of the rounded portion of each boom section 12*a*–12*e*. In addition to engaging the break 16, each identical wear pad 18 is sized to make intimate contact with at least a portion of the flat surfaces surrounding each break 16. In particular, the upper surface of the wear pad 18 shown in FIGS. 2*b* and 3 is substantially V-shaped such that the break 16 is received substantially in a rounded medial notch or groove. Accordingly, the flats adjacent to the break 16 are engaged by the planar upper surface formed at each end of the wear pad 18, which is generally of a substantially uniform thickness. The lower surface 18*b* of each wear pad 18 also includes a similar contour, including a rounded portion for engaging the inside surface adjacent to and including the corresponding break 16 of the next-adjacent boom section 12*b* (which actually is the structure that supports the wear pads 18).

As should be appreciated, the radius of the rounded portion on the upper surface 18*a* of each identical wear pad 18 is slightly less than the radius of the rounded portion on the lower surface 18*b*. This insures that intimate contact is made with both the break 16 along the outer surface of each adjacent inner boom section 12*a*, 12*b*, 12*c* 12*d*, as well as with the inside surface adjacent to the break 16 of the next-adjacent outer boom section 12*b*, 12*c*, 12*d*, 12*e* that supports the wear pad 18. Advantageously, since the breaks 16 are all formed at equal angles, the identical wear pads 18 may be used at each location.

To not only reduce friction in the desired manner, but also to provide an extended service life, the wear pads 18 are preferably formed of a tribologically enhanced material that is highly resistant to wear. An example of such a material is heavy duty nylon or the like, which is easily formed in the desired shape to ensure that the intimate mating contact with the corresponding boom section 12*a*–12*d* is achieved. As noted below, conventional wet or dry lubricants, such as graphite power, may also be externally applied to the surfaces of the wear pads 18 periodically during operation to further reduce the frictional force acting on the corresponding boom section 12*a*–12*d* during telescoping movement.

Figure 2C:
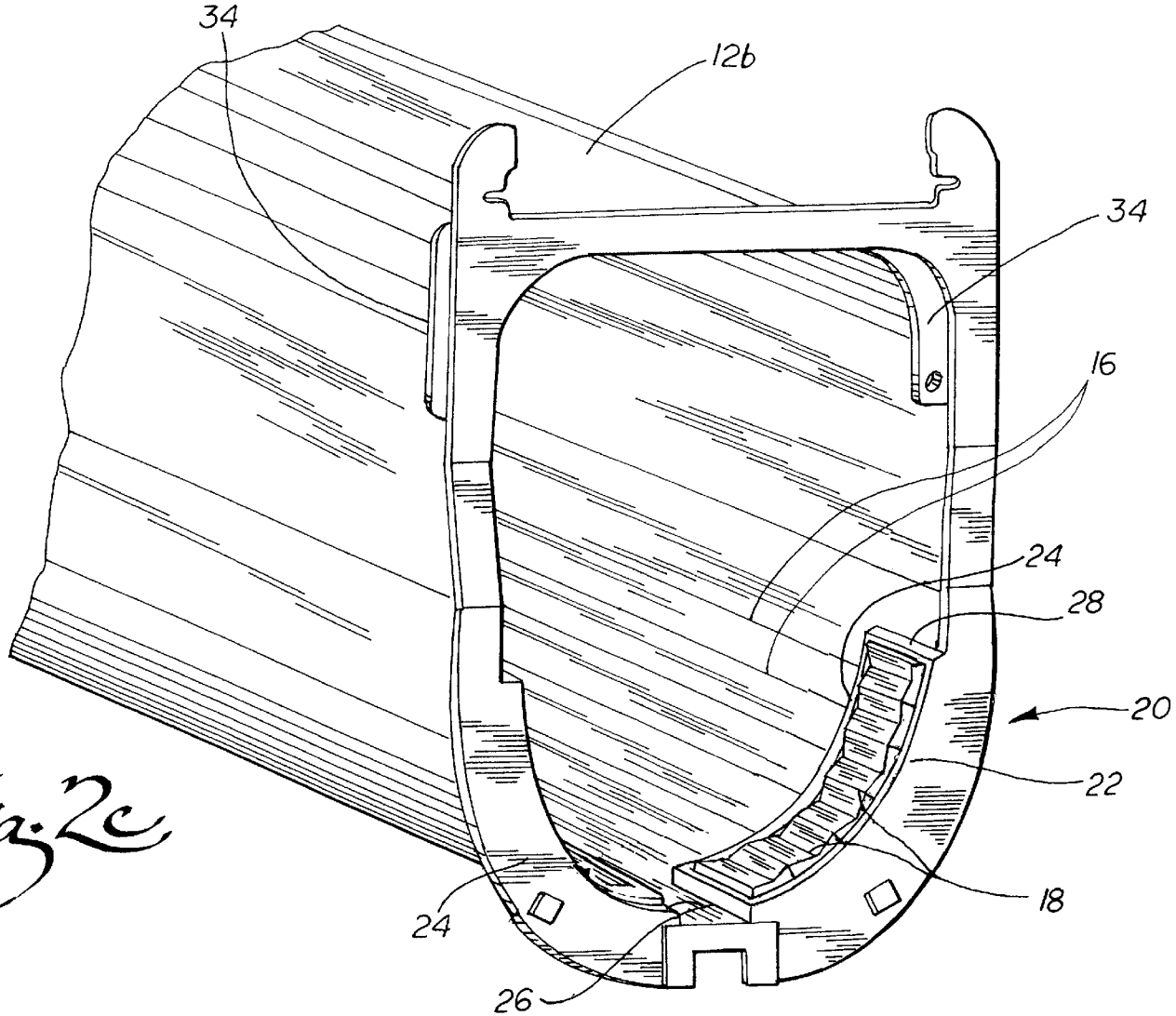
FIG. 2*c* is a partially cutaway perspective view showing the retainer for holding the wear pads in place on the inside surface of an outer boom section.
Figure 7:
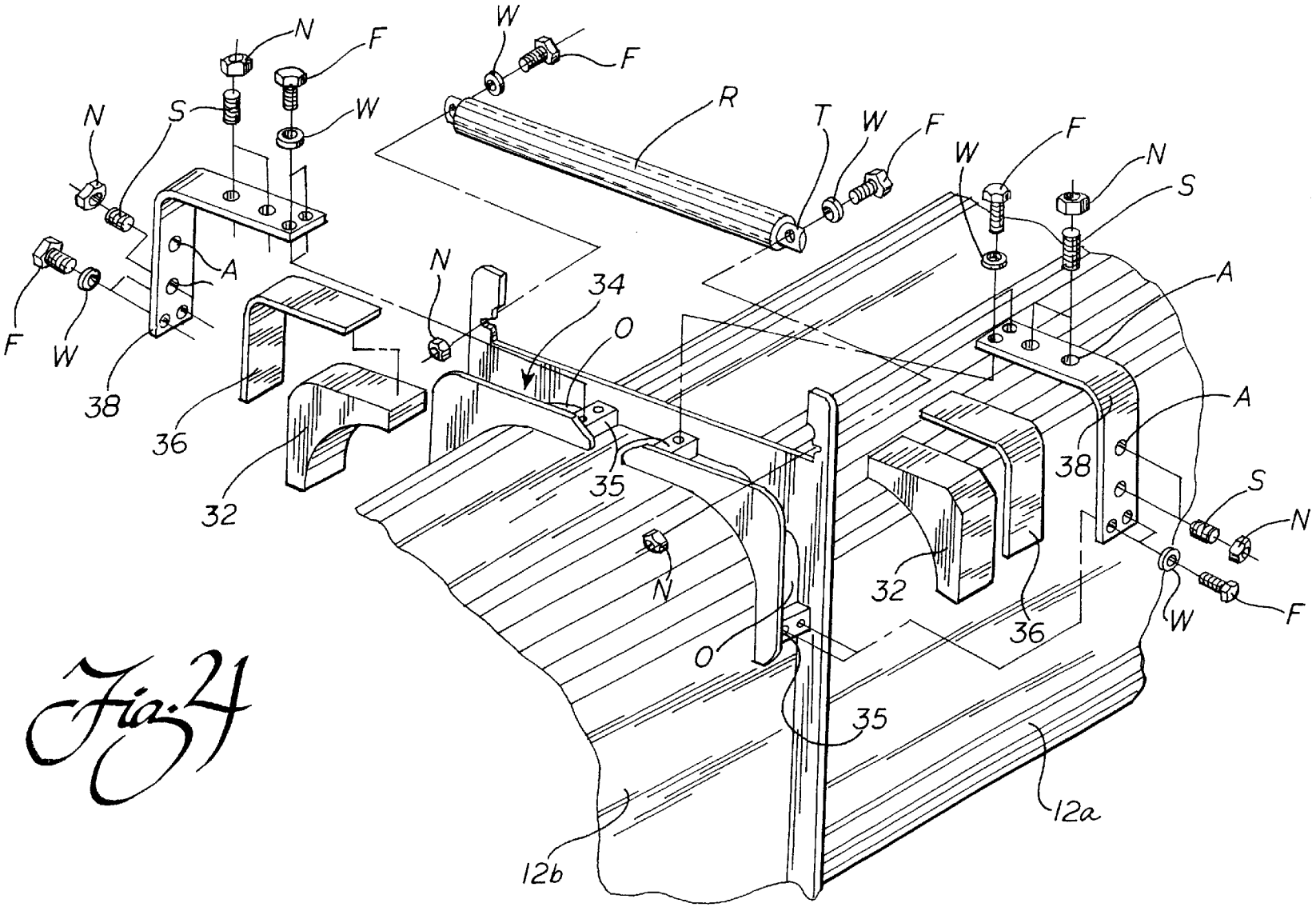

In the preferred embodiment, the identical wear pads 18 for use along each side of the innermost boom section 12*a* are sized and shaped to adjoin with each other when positioned adjacent to the breaks 16 and create a substantially continuous wear surface. To prevent these contiguous wear pads 18 from moving to and fro in the longitudinal direction during the telescoping of the respective adjacent boom section 12*a*–12*d*, a cradle-like retainer 20 is provided on the inner surface of each outer boom section 12*b*–12*e*. As perhaps best shown in FIG. 2*c*, the retainer 20 is preferably divided into two separate sections, each of which includes a transversely extending front wall 22 and a rear wall 24. The lower edge of each wall 22, 24 is contoured and sized to mate with the adjacent inner surface of the corresponding outer boom section 12*b*–12*e* (no retainer 20 is required for the innermost boom section 12*a*). Longitudinally extending first and second end walls 26,28 are provided to connect the ends of the walls 22, 24, and provide an abutment surface for the uppermost and lowermost wear pads 18 positioned on the sides of each boom section 12*b*–12*e*. The front, rear, and end walls 22–28 are each formed having a reduced height relative to the wear pads 18 (see FIG. 2*a*) to avoid making contact with the outer surface of the adjacent inner boom section, such as boom section 12*a*. As should be appreciated, the pieces of material forming the front, side, and end walls 22–28 are attached directly to the inner surface of the corresponding boom section 12*b*–12*e*, such as by welding.

As should be appreciated from the foregoing discussion, the use of a minimal number of relatively non-complex structures to form the retainer 20 is made possible by the use of identical wear pads 18. This results in an advantage over prior art arrangements requiring more substantial welded on structures for containing the various different sizes and shapes of wear pads at the lower front end of each boom section. In addition to reducing the manufacturing time and expense, a savings in weight and an increase in over lap length between adjacent sections is also realized by using the relatively simple retainer 20.

Since the wear pads 18 for positioning next to the breaks 16 of each adjacent boom section 12*a*–12*d* are substantially identical, but the boom sections increase in relative size to permit telescoping, it should be appreciated that gaps or spaces are created between the adjacent wear pads 18 for engaging the outer surfaces of the outer boom sections 12*b*–12*d*. To fill these gaps or spaces and prevent the wear pads 18 from shifting relative to one another, spacers 30 may be provided, such as in the form of separate strips of material for positioning between the pairs of identical wear pads 18 positioned at adjacent breaks 16. As should further be appreciated, in the case where four or more boom sections 12 are present, the spacers 30 must increase in size to fill the larger gap or space created between the adjacent wear pads 18 (compare dimension $D_1$ of spacer 30a supported by boom section 12*e* in FIG. 2*b* with dimension $D_2$ of spacer 30*b* supported by boom section 12*d*). The spacers 30 are preferably rectangular in cross-section and may have the same longitudinal dimension as the identical wear pads 18. In addition, the spacers 30 may be substantially the same height and formed of the same tribologically enhanced material as the wear pads 18 to create a continuous wear surface, or alternatively may be formed having a reduced height and from a different, non-tribologically enhanced material. Still another alternative is to form the spacers integrally with the corresponding boom section 12*c*–12*e* and/or the retainer 20, such as by attaching a plurality of longitudinally extending strips between the front and rear walls 22, 24 at positions necessary to prevent relative shifting. However, one disadvantage of this approach is that gaining full access to the upper edges of the retainer 20 to insert or remove the wear pads 18 is difficult without disassembling the boom assembly 10.

To facilitate installation of the wear pads 18 between two adjacent boom sections, such as sections 12*a* and 12*b*, it is preferable to raise the innermost section 12*a* relative to the adjacent outer section 12*b*. This relative movement creates a clearance or space that allows for the manual insertion of the wear pads 18, usually at the lowest point of the rounded portion. As should be appreciated, moving adjacent boom sections, such as for example boom sections 12*a* and 12*b*, may require first removing any friction-reducing structures provided for engaging the outer surface along the upper portion of the inner boom section 12*a*. In many past proposals, the friction-reducing structures for an inner boom section, such as section 12*a*, are positioned along the inside of the next-adjacent outer boom section, such as section 12*b*, and are inaccessible from outside the boom assembly 10. Obviously, using this arrangement, a great amount of time and effort is required for the worker to gain access to these friction-reducing structures, which may require disassembling the boom assembly 10.

In the boom assembly 10 of the present invention, the lifting operation is facilitated by providing a pair of substantially L-shaped wear shoes 32 mounted external to each outer boom section 12*b*–12*e* that are fully accessible at all times. Each wear shoe 32 includes a contoured lower surface for engaging the outer surface of the corresponding upper corner of the inner boom section 12*a* through an access opening O in the next-adjacent boom section 12*b*. Separate, but substantially identical, external retainers 34 are provided on each outer boom section 12*b*–12*e* around the access openings O. The retainers 34 are adapted for receiving the wear shoes 32 and preventing them from moving in the longitudinal direction.

During installation, an intermediate L-shaped spacer 36 is positioned between the upper surface of each wear shoe 32 and an L-shaped cover 38. The cover 38 is secured to strategically positioned cross members 35 forming part of the retainer 34 by conventional fasteners F (such as cap screws) with optional washers W. By simply removing these fasteners F and lifting the cover 38 and spacer 36, the worker may advantageously gain quick access to each wear shoe 32 for inspection, removal, or replacement, or to allow for the lifting of the corresponding inner boom section, such as section 12*a*, to install or remove the wear pads 18 adjacent to the lower front portion thereof.

The cover 38 further includes at least one, and preferably a plurality of apertures A for receiving a threaded adjustment screw S having a jam nut N secured to its upper end. By adjusting the position of this screw S, either during an initial set-up or during periodic inspections later in the field, the operator may to ensure that the desired degree of engagement is established between the engagement surface of each wear shoe 32 and the outer surface of the boom section 12*a*. As should be appreciated, this feature also allows the worker to keep the alignment of the corresponding telescoping boom section 12*a*–12*d* in check without completely disassembling the boom assembly 10.

As also shown in FIG. 4, a transversely extending roller R is provided for engaging the hoist cable (not shown). The roller R is rotatably supported by a transversely extending support shaft T, the ends of which are mounted to upstanding posts adjacent to the retainers 34 by fasteners F, such as cap screws with nuts. A similar roller R for performing a similar function is preferably provided on each telescoping boom section 12*a*–12*e* (see FIG. 1).

Figure 5A:
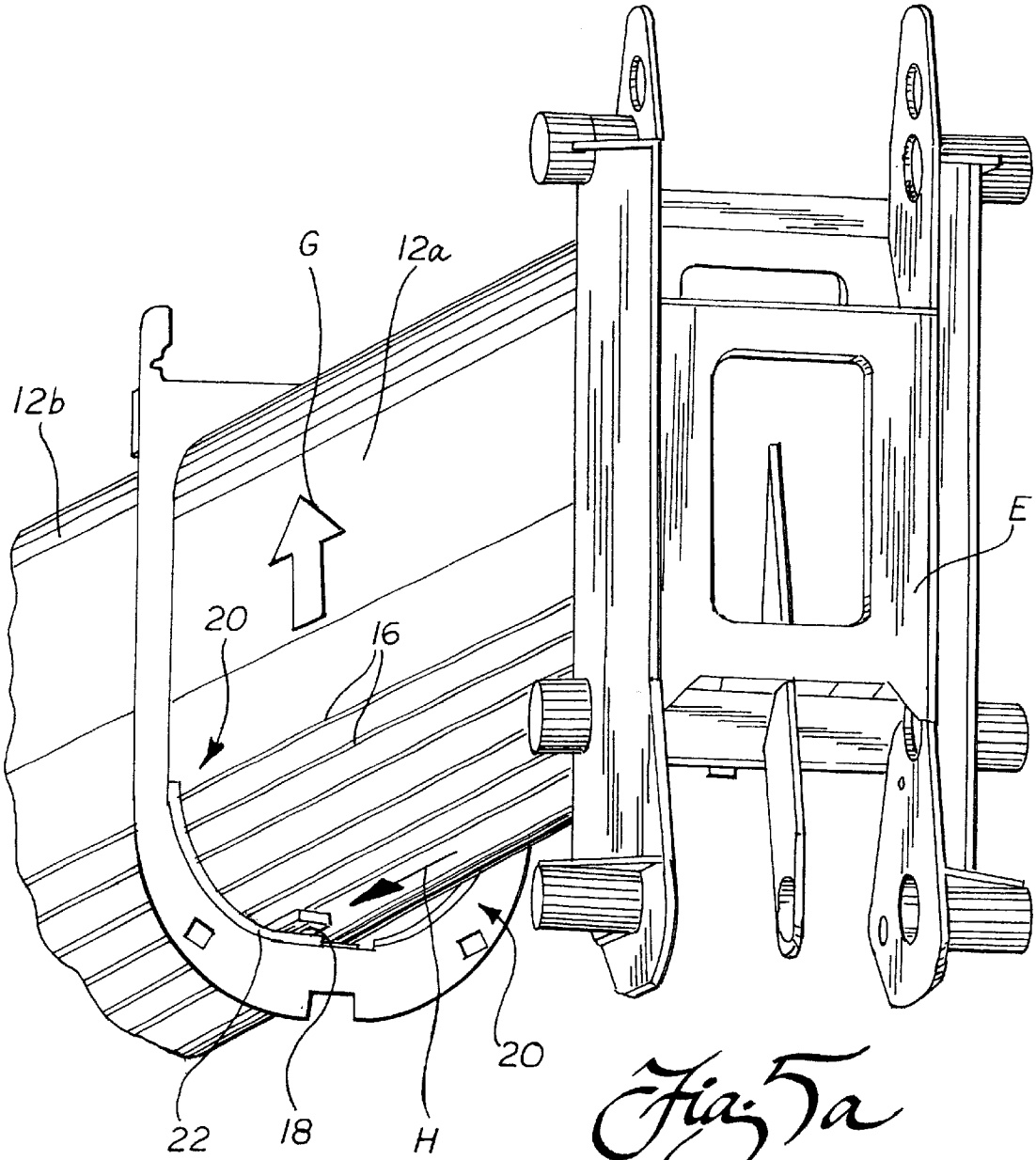
FIG. 5*a* is a partially cutaway perspective view showing the lifting of the inner boom section relative to the next-adjacent outer boom section to create a clearance or space for facilitating the insertion or removal of the wear pads and/or spacers.
Figure 5B:
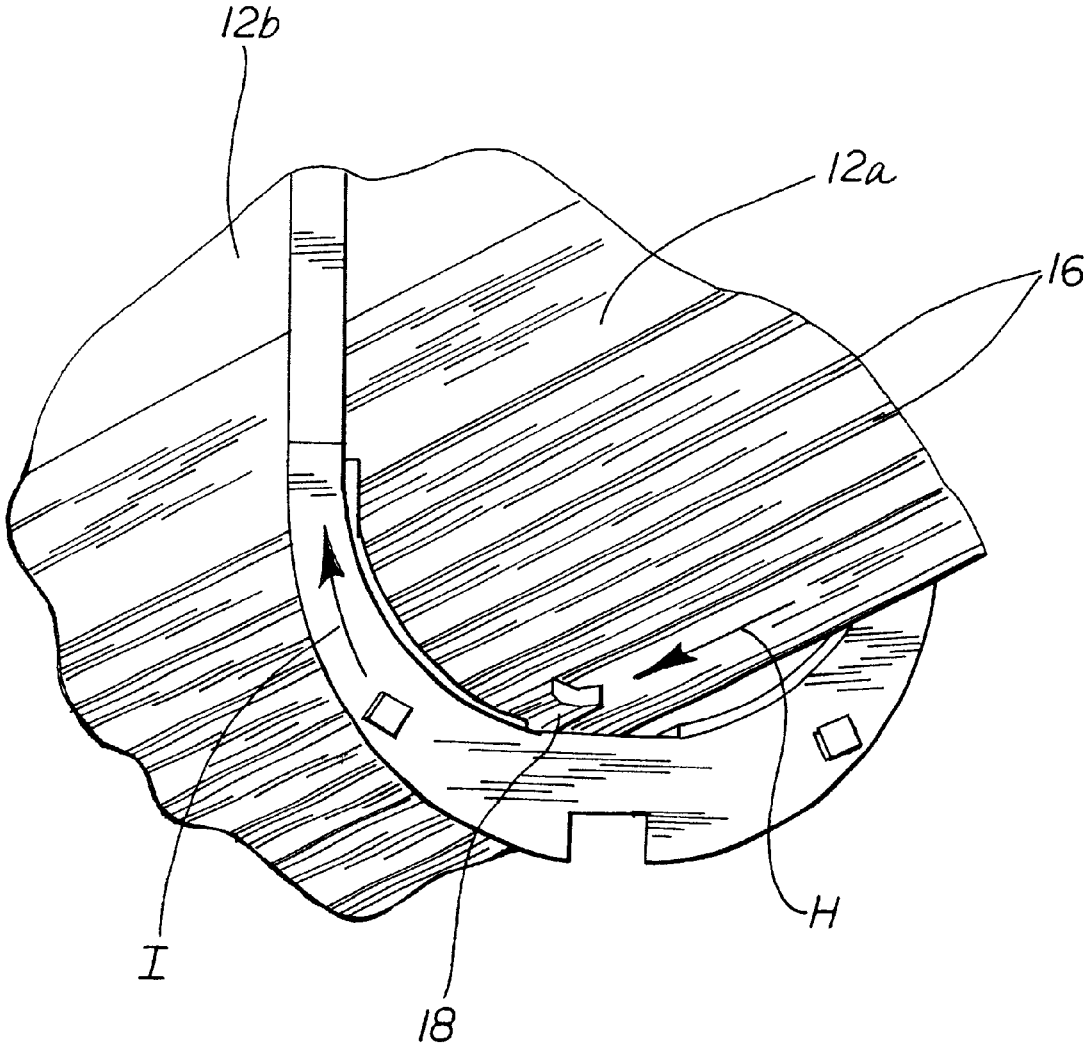
FIG. 5*b* is an enlarged view similar to FIG. 5*a*, showing the manner in which the identical wear pads are installed between adjacent boom sections.

Upon removing the covers 38, moving the wear shoes 32 relative to the retainers 34 is possible. As a result, the inner boom section 12*a* may be lifted relative to the outer boom section 12*b* (which may be accomplished using a hoist or separate lifting structure, or by merely lowering the boom assembly 10 such that the lower portion of the frame defining the head end structure E engages the ground). The raised position of the inner boom section 12*a* is indicated by action arrow G in FIG. 5*a*. The wear pads 18 are then inserted into the clearance or space formed between the boom sections 12*a*, 12*b*. More specifically, each wear pad 18 is positioned in the retainer assembly 12 adjacent to the lowest point of the corresponding outer boom section 12*b*–12*e* (note action arrow H). A next-adjacent wear pad 18 (or spacer 30) is then positioned adjacent to the first wear pad inserted and used to move it laterally along the curved inner surface of the adjacent boom section 12*b* (note action arrow I in FIG. 5*b*). This operation is performed until the wear pads 18/spacers 30 completely fill the retainer 20. Additional lubricant, such as graphite powder, may also be liberally applied to the wear pads 18 to further reduce the friction experienced by each adjacent boom section during telescoping movement.

In the case of the innermost and next-adjacent boom sections 12*a*, 12*b*, the wear pads 18 are installed in an adjoining relationship, positioned with the V-shaped lower surface engaging the inside surface of a corresponding break 16 formed in boom section 12*b*. However, as explained in detail above, to install the identical wear pads 18 for engaging the outer surfaces of the larger boom sections 12*b*–12*d* having equidistant, equiangular breaks 16 and to prevent relative shifting during the telescoping movement, a plurality of different sizes of spacers 30 are employed.

Finally, it should also be appreciated that the proximal end of each inner boom section 12*a*–12*d* may also be provided with friction-reducing structures. These friction-reducing structures may take the form of wear shoes or pads (not shown) fixedly mounted to both the upper and lower portions of the proximal end of each boom section 12*a*–12*d*.

In summary, a telescoping boom assembly 10 for a crane or other device for lifting loads is provided. In addition to a plurality of boom sections 12*a*–12*e*, each having an at least partially rounded profile, the boom assembly 10 includes a plurality of corresponding wear pads 18 for reducing friction between adjacent boom sections during relative telescoping movement. The rounded profile of each boom section 12*a*–12*e* is created by a plurality of equiangular breaks 16. Each wear pad 18 is substantially identical and includes a contoured, V-shaped engagement surface for positioning adjacent to one of the plurality of breaks 16 at the lower front end of each boom section 12*a*–12*e*. Advantageously, the identical wear pads 18 are interchangeable, which eliminates the need for keeping a plurality of substantially different shapes or sizes of wear pads on hand for placement between the lower front ends of adjacent boom sections 12*a*–12*e*. The retainer 20 for holding the wear pads 18 in place is also made simple in construction as a result of their interchangeability. Spacers 30 may also be provided between adjoining identical wearpads 18 positioned adjacent to the breaks 16 on outer boom sections 12*b*–12*e* to prevent shifting during the relative telescoping movement. Lifting each inner boom section 12*a*–12*d* to install the identical wear pads 18 at the lower front end of the next adjacent boom section 12*b*–12*e* is also facilitated by using externally accessible wear shoes 32. Overall, an improved boom assembly 10 is provided, especially in terms of the reduction in the manufacturing and operating cost.

The foregoing description of the several embodiments of the invention has been presented for purposes of illustration and description. The description is not intended to be exhaustive or to limit the invention to the precise form disclosed. Obvious modifications or variations are possible in light of the above teachings. For example, it is again emphasized that the number of breaks provided in each boom section is not critical to the invention. Providing greater or fewer numbers of equidistant, equiangular breaks is possible. These embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A boom assembly for a crane or other lifting device, comprising:

at least two adjacent telescoping boom sections, a first of said boom sections including a rounded portion having a plurality of substantially equiangular breaks formed therein; and a plurality of substantially identical wear pads, each for positioning adjacent to one of said breaks of the first boom section and supported by a matching second, adjacent boom section, whereby the substantially identical wear pads reduce friction between the adjacent boom sections during telescoping and are interchangeable.

2. The boom assembly according to claim 1, wherein the breaks formed in first and second sides of the first boom section are equidistant from each other.

3. The boom assembly according to claim 1, wherein the rounded portion is a lower portion of the first boom section.

4. The boom assembly according to claim 1, wherein each substantially identical wear pad includes a contoured surface for engaging the adjacent break and making intimate contact with at least a portion of an outer surface of the first boom section on either side of the corresponding break.

5. The boom assembly according to claim 4, wherein the contoured engagement surface is substantially V-shaped.

6. The boom assembly according to claim 4, wherein the portion of the outer surface of the first boom section on either side of the corresponding break is substantially flat.

7. The boom assembly according to claim 1, wherein the first boom section is an innermost boom section, and each identical wear pad positioned along a first side of the rounded portion of the innermost boom section is adjacent to an adjoining wear pad.

8. The boom assembly according to claim 7, further including a plurality of spacers for placement between adjacent substantially identical wear pads positioned next to each of a plurality of equiangular breaks formed in a rounded portion of the matching second, adjacent telescoping boom section.

9. The boom assembly according to claim 1, wherein each of said plurality of adjacent, telescoping boom sections includes a rounded portion having a plurality of substantially equiangular breaks, and wherein one of said plurality of substantially identical wear pads is positioned adjacent to each said break of the second boom section and supported by a matching adjacent third boom section.

10. The boom assembly according to claim 9, wherein the rounded portion of each of said first, second, and third telescoping boom sections is formed having an identical number of substantially equiangular breaks, and wherein a plurality of different sizes of spacers are provided for positioning in any gap or space between adjacent wear pads next to the breaks of the matching second boom section and supported by the third boom section, whereby the spacers substantially prevent adjacent wear pads from shifting relative to each other.

11. The boom assembly according to claim 1, wherein the second boom section includes a retainer for holding the plurality of identical wear pads in place adjacent to the corresponding breaks during the telescoping of the adjacent first boom section.

12. The boom assembly according to claim 1, further including a plurality of wear shoes for engaging an upper portion of the first boom section, whereby upon removing the wear shoes from an operative position, the first boom section may be lifted relative to the section adjacent boom section to provide a clearance for inserting the plurality of wear pads.

13. The boom assembly according to claim 12, further including an adjustment mechanism for selectively adjusting the position of the plurality of wear shoes relative to the corresponding upper portion of the first boom section, whereby alignment of the first boom section relative to the second boom section may be controlled.

14. In a crane or other lifting device, an apparatus for assisting in lifting or moving a load, comprising:

a telescoping boom assembly including at least two adjacent telescoping boom sections, a first of said boom sections having a rounded portion including a plurality of substantially equiangular breaks formed therein, and a plurality of substantially identical wear pads, each for positioning adjacent to one of said breaks of the first boom section and supported by a matching second, adjacent boom section, whereby the substantially identical wear pads reduce friction between the adjacent boom sections and are interchangeable.

15. The apparatus for a crane or lifting device according to claim 14, wherein the first boom section is an outer boom section, and further including a plurality of spacers for positioning between the adjacent identical wear pads positioned next to the breaks on an outer surface of the outer boom section.

16. The apparatus for a crane or lifting device according to claim 14, wherein each of said plurality of adjacent, telescoping boom sections includes a rounded portion having a plurality of substantially equiangular breaks, and wherein one of said plurality of substantially identical wear pads is positioned adjacent to each said break on the second boom section and supported by an adjacent third telescoping boom section.

17. The apparatus for a crane or lifting device according to claim 16, wherein the rounded portion of each of said first, second, and third telescoping boom sections is formed having an identical number of substantially equiangular breaks, and wherein a plurality of different sizes of spacers are provided for positioning in any gap or space between adjacent wear pads adjacent to the breaks in the second boom section and supported by the third boom section, whereby the spacers substantially prevent adjacent wear pads from shifting relative to each other.

18. In a crane or lifting device having a boom assembly comprised of first and second adjacent telescoping boom sections, with at least the first boom section having a rounded portion including a plurality of substantially equiangular breaks formed therein, a structure for reducing the friction between the adjacent first and second boom sections during telescoping, comprising:

a plurality of substantially identical wear pads, each having a substantially V-shaped engagement surface for positioning adjacent to one of said breaks of the first boom section and supported by the second, adjacent boom section, whereby the substantially identical wear pads reduce friction between the adjacent boom sections and are interchangeable.

19. The friction-reducing structure according to claim 18, further including a plurality of spacers for positioning between adjacent wear pads.

20. A method for reducing friction in a boom assembly including at least two adjacent telescoping sections, comprising:

placing one of a plurality of substantially identical wear pads adjacent to each of a corresponding plurality of substantially equiangular breaks forming a rounded portion of a first of the two adjacent telescoping boom sections, whereby the substantially identical wear pads reduce friction between the adjacent boom sections and are interchangeable.

21. The method according to claim 20, wherein the step of placing includes raising the first boom section relative to a second adjacent boom section to provide a clearance for moving each of the substantially identical wear pads into place adjacent to the corresponding break.

22. The method according to claim 20, wherein the step of placing further includes providing a spacer in any gap or space between the substantially identical wear pads positioned at adjacent breaks, whereby the spacers substantially prevent the wear pads from shifting relative to each other.

23. The method according to claim 20, wherein a plurality of rounded boom sections are provided, with each rounded portion having a identical number of substantially equidistant breaks, and the step of placing further includes:

providing a first spacer having a first width dimension between the wear pads adjacent to a second boom section having a smaller cross-sectional size than a third boom section; and providing a second spacer having a second width dimension between the wear pads adjacent to a fourth boom section having a greater cross-sectional size than the third boom section.

* * * * *

UNITED STATES PATENT AND TRADEMARK OFFICE

CERTIFICATE OF CORRECTION

PATENT NO. : 6,499,612 B1 
DATED : December 31, 2002
INVENTOR(S) : Daniel L. Harrington and Shannon J. Murphy It is certified that error appears in the above-identified patent and that said Letters Patent is hereby corrected as shown below:

Title page,
Item [75], Inventors, please replace "Daniel L. Harrgington" with
-- Daniel L. Harrington --.

Signed and Sealed this

Tenth Day of June, 2003

JAMES E. ROGAN
*Director of the United States Patent and Trademark Office*